US011795699B2

(12) United States Patent
Myer

(10) Patent No.: US 11,795,699 B2
(45) Date of Patent: Oct. 24, 2023

(54) SKIRT PANEL SYSTEM FOR A POST-FRAME BUILDING AND METHODS THEREOF

(71) Applicant: 1563100 Alberta Ltd., Okotoks (CA)

(72) Inventor: Jerry Benjamin Myer, Foothills (CA)

(73) Assignee: 1563100 Alberta Ltd., Okotoks (CA)

( * ) Notice: Subject to any disclaimer, the term of this patent is extended or adjusted under 35 U.S.C. 154(b) by 0 days.

(21) Appl. No.: 17/249,166

(22) Filed: Feb. 22, 2021

(65) Prior Publication Data

US 2021/0262239 A1 Aug. 26, 2021

Related U.S. Application Data

(60) Provisional application No. 62/981,150, filed on Feb. 25, 2020.

(51) Int. Cl.

| | |
|---|---|
| ***E04F 13/08*** | (2006.01) |
| ***E04F 13/14*** | (2006.01) |
| ***E04B 2/00*** | (2006.01) |
| ***E04C 2/04*** | (2006.01) |
| ***E04C 2/34*** | (2006.01) |
| ***E04B 1/18*** | (2006.01) |
| ***E04B 1/343*** | (2006.01) |

(52) U.S. Cl.

CPC ..... *E04F 13/0841* (2013.01); *E04B 1/18* (2013.01); *E04C 2/044* (2013.01); *E04C 2/34* (2013.01); *E04C 2/44* (2013.01); *E04F 13/0894* (2013.01); *E04F 13/141* (2013.01); *E04B 1/34342* (2013.01)

(58) Field of Classification Search

CPC .. E04F 13/0841; E04F 13/0894; E04C 2/044; E04C 2/44; E04B 1/34342

See application file for complete search history.

(56) References Cited

U.S. PATENT DOCUMENTS

| | | | | |
|---|---|---|---|---|
| 6,125,597 | A * | 10/2000 | Hoffman | E02D 27/02 52/293.3 |
| 6,374,552 | B1 * | 4/2002 | Price | E04B 2/06 52/779 |
| 6,453,627 | B1 * | 9/2002 | Powers | E04B 1/34342 52/745.1 |
| 6,935,083 | B2 | 8/2005 | Chezum | |
| 7,325,363 | B2 * | 2/2008 | Davis | E02D 27/01 256/65.14 |

(Continued)

*Primary Examiner* — Gisele D Ford

(74) *Attorney, Agent, or Firm* — Gowling WLG (Canada) LLP

(57) ABSTRACT

The present disclosure provides skirt panel systems for a post-frame building, comprising: one or more precast skirt panels, each of the precast skirt panels having an outer surface to be oriented away from the interior of the post-frame building, an inner surface to be oriented towards the interior of the post-frame building, a top, a bottom, and two opposing ends, each of the precast skirt panels configured for attachment to at least one post of the post-frame building, and each of the precast skirt panels configured for abutting each other end-to-end to form a skirt wall on the post-frame building; and an attachment apparatus for attaching the one or more precast skirt panels to the at least one post. The present disclosure also provides methods for constructing a post-frame building using such systems.

16 Claims, 5 Drawing Sheets

(56) References Cited

U.S. PATENT DOCUMENTS

| | | | | |
|---|---|---|---|---|
| 7,681,362 | B1 * | 3/2010 | Averitt | E04B 1/34342 52/169.12 |
| 7,905,067 | B2 * | 3/2011 | Schiffmann | E04B 1/0007 52/309.3 |
| 9,109,355 | B1 * | 8/2015 | Strauch | E04B 1/34347 |
| 9,187,893 | B2 * | 11/2015 | Stanfill | E04B 1/34342 |
| 9,493,938 | B2 * | 11/2016 | Schiffmann | E04C 2/46 |
| 2003/0033773 | A1 * | 2/2003 | Houpapa | E02D 27/02 52/294 |
| 2003/0188497 | A1 * | 10/2003 | Price | E02D 27/01 52/169.12 |
| 2007/0163203 | A1 * | 7/2007 | Price | E04F 13/0821 52/834 |

* cited by examiner

SKIRT PANEL SYSTEM FOR A POST-FRAME BUILDING AND METHODS THEREOF

CROSS-REFERENCE TO RELATED APPLICATIONS

This application claims priority to and benefit of U.S. Provisional Patent Application No. 62/981,150 filed on Feb. 25, 2020, the disclosure of which is incorporated herein by reference in its entirety.

TECHNICAL FIELD

The present disclosure relates generally to skirt panel systems for a post-frame building, as well as methods for constructing a post-frame building using the skirt panel system and uses of the skirt panel system in the construction of post-frame buildings.

BACKGROUND

Post-frame structures differ from traditional structures in that they do not require a continuous below grade perimeter foundation. Commonly, large sheets of metal siding are affixed to the post-frame structure above grade to hide the underside of the structure and provide an element of protection and structural integrity. The siding also adds to the security and safety of the structure.

While widely used and highly functional, metal siding lacks a degree of durability. The most common causes for post-build repairs are due to damage to the bottom 2-4 feet (24-48 inches). Post-frame building owners face damage from numerous factors including, but not limited to rust, physical damage due to mechanical or environmental factors (e.g. dents, scratches, holes, etc.), and livestock injury (e.g. leg through metal siding). Moreover, due to the large sheet size of metal siding, the mode of installation, application of eavestroughs, plus additional factors, the replacement of siding is difficult and costly.

Full "floor-to-ceiling" metal siding also lacks a degree of aesthetic appeal for many post-frame building owners. As post-frame structures increase in popularity outside the traditional segment of shops, barns and arenas, without a functional, durable and aesthetically pleasing siding, these types of builds can suffer from the stigma associated with agricultural buildings.

Therefore, a need exists for improved exterior cladding of a post-frame structure that improves the building process and can also improve the durability and lifespan of the exterior and/or interior of the structures. A suitable cladding may also extend the applicability of post-frame structures to types of buildings not conventionally built using post-frame technology.

SUMMARY

The present disclosure recognizes that there are problems in the current existing technologies in respect of claddings for post-frame buildings, including materials and methods of manufacturing post-frame buildings.

An advantage of the present disclosure is the provision of a skirt panel system for a post-frame building that has improved characteristics over existing technologies. For example, in an aspect, the present disclosure provides a skirt panel system that essentially acts to replace grade beam applications that require excavation below the frost line prior to site cribbing, site pour and framing.

In an embodiment, the present disclosure relates to a skirt panel system for a post-frame building, comprising one or more precast skirt panels, each of the precast skirt panels having an outer surface to be oriented away from the interior of the post-frame building, an inner surface to be oriented towards the interior of the post-frame building, a top, a bottom, and two opposing ends, each of the precast skirt panels configured for attachment to at least one post of the post-frame building.

In some embodiments, the one or more precast skirt panels are precast of a rigid, durable material. In further embodiments, the one or more precast skirt panels are precast of concrete and may further comprise an internal reinforcement, such as, for example, metal rebar. In some embodiments, the one or more precast skirt panels have a thickness of about 2 inches to about 4 inches, as measured from the outer surface to the inner surface.

In some embodiments, the one or more precast skirt panels comprise an external moulding and/or interior moulding that is on the outer or inner surface of the precast skirt panels, respectively. In some embodiments, the moulding is a decorative moulding and/or an insulative moulding (e.g. for temperature regulation or protection of the post-frame building).

In some embodiments, the skirt panel system further comprises an attachment apparatus for attaching the one or more precast skirt panels to the at least one post. In further embodiments, the attachment apparatus is configured to be fixedly connected to a post of the post-frame building and to a single panel of the one or more precast skirt panels. In other embodiments, the attachment apparatus is configured to be fixedly connected to a post of the post-frame building and to two panels of the one or more precast skirt panels. In some embodiments, the attachment apparatus is configured to bridge a first panel and a second panel of the one or more precast skirt panels. In some embodiments, the attachment apparatus is configured to be fixedly connected to a post and slidably connected to the one or more precast skirt panels, such that the one or more precast skirt panels can be slidably disposed along a wall of the post-frame building.

In some embodiments, the attachment apparatus comprises a bracket, such as, for example, an L-shaped bracket. In some embodiments, each of the brackets is configured to attach the one or more precast skirt panels to the post of the post-frame building at both the top and the bottom. In other embodiments, each of the brackets is configured to attach the one or more precast skirt panels to the post of the post-frame building at either the top or the bottom. In some embodiments, the skirt panel system comprises a bottom bracket that is configured such that the one or more precast skirt panels can be slidably disposed and a top bracket that is configured such that the one or more precast skirt panels can be fixedly attached in a fixed position.

In some embodiments, the one or more precast skirt panels are between about 2 feet to about 4 feet in height from the bottom to the top.

In some embodiments, the skirt panel system further comprises a multi-functional top beam that is (i) configured to be fixedly connected to the at least one post and to the attachment apparatus for the one or more precast skirt panels, and (ii) configured to provide a mounting surface for a building siding. In some embodiments, the building siding is a metal siding.

In some embodiments of the skirt panel system disclosed herein, each of the precast skirt panels is configured for abutting each other end-to-end to form a skirt wall on the post frame building. In some embodiments of the skirt panel system disclosed herein, a first end of the one or more precast skirt panels comprises a groove and a second end of the one or more precast skirt panels comprises a corresponding tongue, so as to form a tongue-and-groove connection between adjacent panels when installed in a post-frame building.

In some embodiments, the skirt panel system disclosed herein, when installed on a post-frame building, is configured to replace a grade beam foundation that requires excavation below a frost line. In some embodiments of such aspects, the one or more precast skirt panels and the attachment apparatus are configured such that the one or more precast skirt panels can be installed on the post-frame building with the bottom of the one or more precast skirt panels adjacent an exterior surface of a concrete slab of the post-frame building.

In some embodiments of the skirt panel system disclosed herein, the one or more precast skirt panels comprise interior skirt panels that are configured to be installed on the interior side of the post of the post-frame building.

In some embodiments of the skirt panel system disclosed herein, the one or more precast skirt panels comprise exterior skirt panels that are configured to be installed on the exterior side of the post of the post-frame building.

In some embodiments of the skirt panel system disclosed herein, the one or more precast skirt panels, when installed on a post-frame building, are individually replaceable.

In another embodiment, the present disclosure relates to a method for constructing a post-frame building, the method comprising setting in place, upright, one or more posts of a post-frame building; and attaching to the one or more posts the skirt panel system as disclosed herein.

In some embodiments of the methods disclosed herein, attaching the skirt panel system to the one or more posts is by mounting L-shaped brackets to the one or more posts and attaching the one or more precast skirt panels to the L-shaped brackets.

In some embodiments, the methods disclosed herein further comprise pouring a concrete slab for the post-frame building. In some embodiments, attaching the skirt panel system to the one or more posts comprises positioning the bottom of the one or more precast skirt panels adjacent or below an exterior surface of the concrete slab. In some embodiments, the bottom of the one or more precast skirt panels is aligned with the bottom of the concrete slab. In some embodiments, the bottom of the one or more precast skirt panels is at a depth that is between about 2 inches to about 5 inches below grade.

In some embodiments of the methods disclosed herein, setting in place, upright, the one or more posts of the post-frame building comprises positioning one end of the one or more posts below a frost line. In some embodiments, positioning the one end of the one or more posts below the frost line comprises setting the one end at a depth of between about 3 feet to about 5 feet below grade.

In some embodiments, the methods disclosed herein comprise attaching the one or more panels of the skirt panel system to an interior side of the one or more posts and/or to an exterior side of the one or more posts.

In some embodiments, the methods disclosed herein further comprise affixing a building siding to the post-frame building above the one or more precast skirt panels.

In another embodiment, the present disclosure relates to use of the skirt panel system as disclosed herein in the construction of a post-frame building.

BRIEF DESCRIPTION OF THE FIGURES

Further advantages, permutations and combinations of the invention will now appear from the above and from the following detailed description of the various particular embodiments of the invention taken together with the accompanying drawings, each of which are intended to be non-limiting, in which.

DETAILED DESCRIPTION

Figure 1:
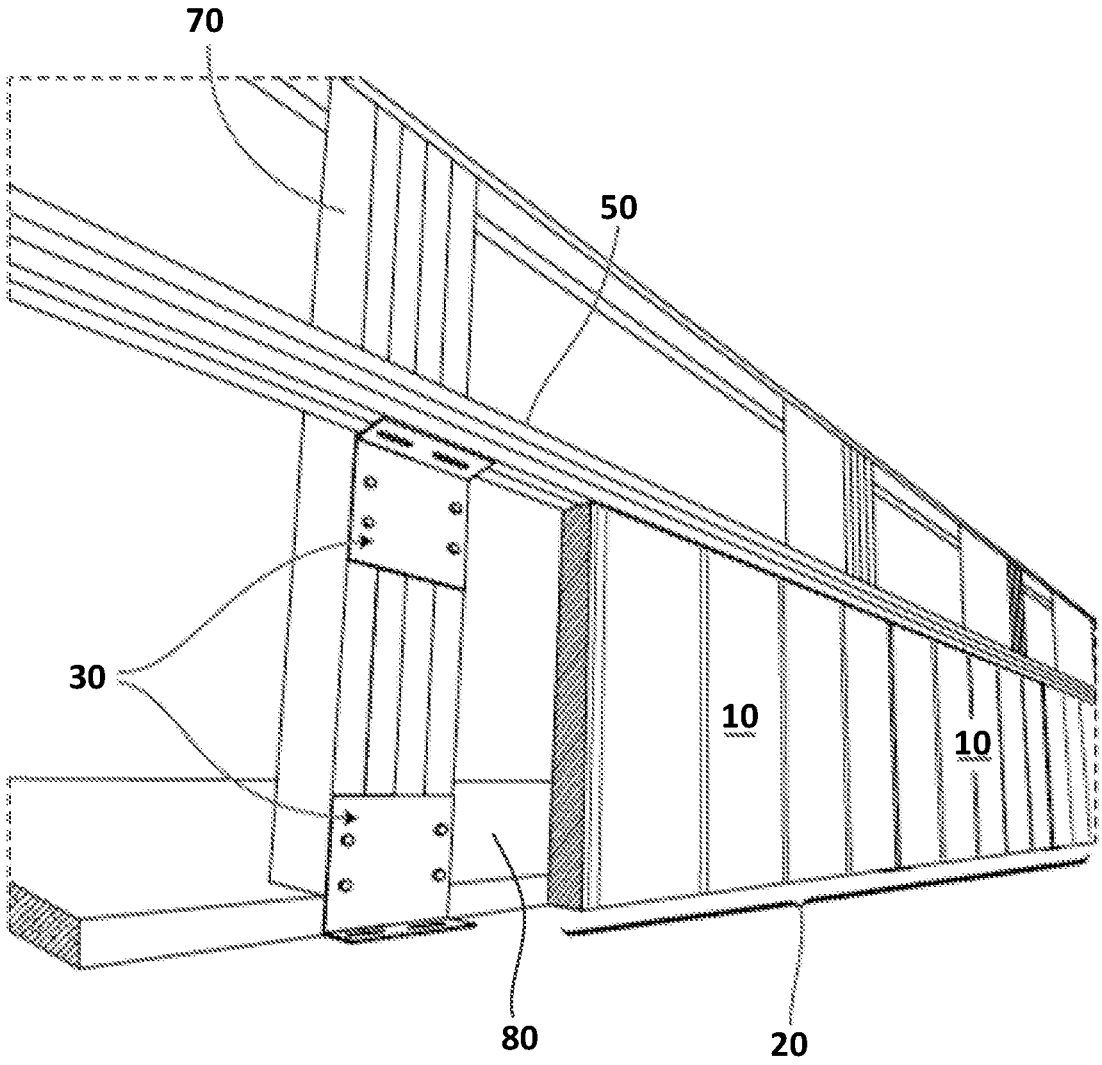
FIG. 1 is a perspective view of a skirt panel system according to one embodiment of the present disclosure.

Post-frame structures differ from traditional structures in that they do not require a continuous below grade perimeter foundation. Commonly, large sheets of metal siding are affixed to the post-frame structure above grade to hide the underside of the structure and provide an element of protection and structural integrity. While widely used and highly functional, metal or other types of siding lacks a degree of durability and also limits the types of buildings in which post-frame technology can be employed.

The present disclosure provides an advantageous skirt panel system for a post-frame building. More particularly, the present disclosure provides a skirt panel system for a post-frame building that is comprised of one or more precast skirt panels that are of a solid, rigid construction (e.g. concrete) and can be easily installed, for example, via an attachment apparatus.

An advantage of the design of the presently disclosed skirt panel system is that the precast panels can act to replace typical grade beam applications that require excavation below the frost line, site cribbing, site pour and framing.

A grade beam structure will typically be used for a few different objectives. One objective is to have a continuous solid structure that extends below the frost line to prevent frost from getting underneath and heaving the concrete floor, and subsequently the building. Another objective of a grade beam is to raise the framing and siding above ground level to prevent physical damage to these sensitive components (e.g. exterior siding). Yet another objective of a grade beam is to prevent rodents from entering the building by having a continuous solid structure that extends from below grade to about two feet above grade.

In constructing a post-frame building, in accordance with embodiments of the present disclosure, the posts may be drilled and placed below the frost line to prevent heaving of the building and thus avoiding the need for a grade beam to achieve the first objective. However, a building having a grade beam is still required to achieve other objectives, such as those noted above. Thus, post-frame buildings have been of limited application and have previously been unable to replace certain grade beam applications and objectives.

Buildings that do require a perimeter foundation or a grade beam substantially increase the cost of the build because of the need for extensive excavating around the perimeter, as well as the cost of constructing the foundation. Any grade beam applications that require excavation below the frost line take time, require heavy equipment, more trades, and specialized labour, while also being restricted to environmental factors that impact concrete pouring.

The skirt panel system of the present disclosure is advantageous in that it can replace the need for a grade beam, and therefore expands the applicability of post-frame technology to types of buildings conventionally constructed with a grade beam. For example, by attaching the precast panels disclosed herein to the posts of a post-frame building with the bottom of the panels positioned slightly below grade (e.g. 3-4 inches), the skirt panel system of the present disclosure provides a solid, rigid structure that resists physical damage and prevents access by rodents. The skirt panel system herein can be easily installed and a builder does not need to excavate a perimeter trench, pour a strip footing, crib the grade beam, pour the walls, and then backfill the walls. Thus, the skirt panel system disclosed herein saves a significant amount of costs, labor and time. Also, ground disturbance at build sites is minimized, providing a reduction in the need for heavy machinery and also providing environmental benefits.

Another advantage of the skirt panel system of the present disclosure is that it may be applied to one or both of the interior and exterior of the post-frame building based on a user's need. For example, in applications in which there is a high probability of physical damage to the lower 2-4 feet on the inside of a post-frame building, the skirt panel system can be attached to the inner sides of the posts. As an example, in a post-frame building that houses animals, it may be advantageous to attach the precast panels to the inner sides of the posts to provide a solid structure that resists physical damage (e.g. by the scoop of a tractor).

Another advantage of the skirt panel system of the present disclosure is that the precast panels improve the durability and lifespan of the exterior of a post-frame building, while also improving the aesthetic appeal. For example, unlike metal siding that can be easily damaged by gardening and other equipment, the precast panels herein are resistant to such damage. Also, a moulding may be applied to the precast panels to provide aesthetic appeal, which may also be customizable to the customer's preference, much unlike the unattractive look of a grade beam wall.

A further advantage of the skirt panel system of the present disclosure is that the precast skirt panels may also be installed on a building that has been constructed using a perimeter foundation or grade beam. In such instances, the precast skirt panels may be positioned on top of the perimeter foundation or grade beam. Buildings constructed using a perimeter foundation or a grade beam, with the skirt panel system installed thereon, may therefore afford the advantages previously described herein. For example, the skirt panels may still provide increased protection for the posts of the building while also preventing unwanted pests (e.g. rodents) from entering the building.

Overall, advantages to a builder provided by the skirt panel system disclosed herein include, without limitation, no excavation, minimal ground disturbance, durability, less trades and equipment, year-round construction, and less of an impact of environmental conditions. Advantages to a building owner include, without limitation, a better envelope seal to prevent rodents from entering the building, less damage to the bottom section of the building (e.g. dents, holes, scratches, etc.), reduced risk of rusting, improved safety of livestock, ability to duplicate the look and feel of a foundation or grade beam building, and allowing for incorporation of desired architectural features (e.g. through the use of moulded shapes and colours).

Reference will now be made in detail to exemplary embodiments of the disclosure, wherein numerals refer to like components, examples of which are illustrated in the accompanying drawings that further show exemplary embodiments, without limitation.

Skirt Panel System

In one embodiment, the present disclosure relates to a skirt panel system for a post-frame building, comprising one or more precast skirt panels, each of the precast skirt panels having an outer surface to be oriented away from the interior of the post-frame building, an inner surface to be oriented towards the interior of the post-frame building, a top, a bottom, and two opposing ends, each of the precast skirt panels configured for attachment to at least one post of the post-frame building.

As used herein, the term "skirt panel system" is meant to refer to a product for a post-frame building, the components of which work together to install one or more precast skirt panels on the building.

As used herein, "post-frame" buildings are intended to encompass buildings or structures that are constructed using vertically-oriented posts (or, in some cases, poles) that are buried into the ground or anchored to a foundation to provide vertical structural support. In colder climates, the post-frame buildings may be constructed such that posts are buried into the ground at a point below the frost line for additional structural support and stability during temperature shifts. The posts may be formed of wood, metal, or other suitable materials. For horizontal support, the post-frame buildings may include girts, which extend horizontally between posts.

The skirt panel systems of the present disclosure comprise one or more precast skirt panels. As used herein, "precast" means that the one or more skirt panels are manufactured prior to installation on a post-frame building. In an embodiment, the one or more skirt panels are manufactured prior to both delivery and installation on a post-frame building. In an embodiment, the precast skirt panels are in their final shape before installation, with or without an external moulding such as described herein. The precast skirt panels will be described in further detail below.

As used herein, the term "skirt panel" is intended to refer to a panel that, when installed, is vertically oriented and positioned generally at the base of a post-frame building (i.e. a bottom portion of a wall or post of the post-frame building or adjacent to an exterior side of a concrete slab of the building). The skirt panels may serve to protect the base of the post-frame building. Further, the skirt panels may serve to provide additional structural support to the post-frame building as well as to make the building more visually appealing. These aspects will be discussed in more detail below.

Each skirt panel has an outer surface and an inner surface. The outer surface, when the panel is installed, is oriented away from the interior of the building (i.e. faces away from the interior of the building), while the inner surface, when the panel is installed, is oriented towards the interior of the post-frame building (i.e. faces towards the interior of the building). Each skirt panel also has a top, a bottom, and two opposing ends.

One or more of the skirt panels are used to form a skirt wall. When the skirt wall is formed of more than one skirt panel, the skirt panels may be arranged end-to-end (i.e. such that one of the opposing ends of one skirt panel is adjacent one of the opposing ends of another skirt panel) to form the skirt wall. As will be appreciated, the skirt panels may be arranged end-to-end in a straight line or, when at a corner of the building for example, end-to-end at an angle. The skirt wall may extend along the entire perimeter of the building or, in some cases, only a portion thereof, depending on the length and number of skirt panels used to form the skirt wall.

Referring now to FIGS. 1 to 5, there is illustrated an example skirt wall 20. As described previously herein, the skirt wall 20 is formed of one or more precast skirt panels 10. In the illustrated embodiment, the skirt wall 20 is formed of two precast skirt panels 10. In one embodiment, the one or more precast skirt panels 10 are about 1 foot to about 10 feet in height, as measured from the bottom to the top. In further embodiment, the one or more precast skirt panels 10 are about 2 feet to about 4 feet in height, as measured from the bottom to the top. In a particular embodiment, the one or more precast skirt panels 10 are about 2 feet in height, as measured from the bottom to the top. Further, in one embodiment, the one or more precast skirt panels 10 have a thickness of about 1 inch to about 12 inches, as measured from the outer surface to the inner surface. In a particular embodiment, the one or more precast skirt panels 10 may have a thickness of about 2 inches to about 4 inches, as measured from the outer surface to the inner surface. In another particular embodiment, the one or more precast skirt panels 10 may have a thickness of about 4 inches to about 8 inches, as measured from the outer surface to the inner surface. However, as will be appreciated, the height and/or thickness of the one or more precast skirt panels 10 may be less than or greater than the ranges previously described herein, depending on the desired application of the skirt panel system.

As described previously herein, the one or more skirt panels 10 of the skirt panel system of the present disclosure are precast. In an embodiment, the one or more precast skirt panels 10 are precast of a solid, rigid (i.e. not malleable or flexible) material that is durable with respect to factors such as weathering and physical damage (e.g. dents scratches, holes, etc.). In a particular embodiment, the one or more precast skirt panels 10 are precast of, for example, a metal, concrete, brick, building stone such as marble, granite, and limestone, cast stone, clay and the like. In a yet further particular embodiment, the skirt panels 10 are precast of concrete.

In some embodiments, the one or more precast skirt panels 10 may comprise an internal reinforcement (not shown). By "internal reinforcement", it is meant that precast skirt panels 10 are reinforced in a manner that is not, at least partially, externally visible. In an embodiment, precast skirt panels 10 comprise an internal reinforcement that is not externally visible. In one embodiment, the internal reinforcement may provide increased structural support and durability to the one or more precast skirt panels 10. A variety of materials and techniques for the internal reinforcement may be used and are contemplated. For example and without limitation, the internal reinforcement may comprise a metal. Thus, in embodiments where the one or more precast skirt panels 10 are precast of materials such as concrete or brick, the internal reinforcement may be, for example, rebar or a metal mesh. However, in embodiments where the precast skirt panel 10 is formed of a metal, the internal reinforcement may comprise alloying the metal to provide strengthened physical properties such as hardness or durability. In alterative embodiments, the internal reinforcement may comprise a non-metal material such as a fiber-reinforced plastic (FRP).

In a further embodiment, the one or more precast skirt panels 10 may comprise an external moulding (not shown). The external moulding may comprise an exterior moulding that is on the outer surface of the one or more precast skirt panels 10. As well or alternatively, the external moulding may comprise an interior moulding that is on the inner surface of the one or more precast skirt panels 10. The external moulding (i.e. the exterior and/or the interior mouldings) may be, for example, a metallic, a polymeric, a wood, or a stone moulding. As well, the external moulding may be secured to the one or more precast skirt panels 10 using any suitable means known in the art. For example and without limitation, the external moulding may be secured by way of fasteners such as screws, bolts, and the like, or by way of adhesives such as epoxies and construction-grade glues. The external moulding may be a decorative moulding and/or may have a functional purpose. For example, in some embodiments, the external moulding may be an insulative moulding for temperature regulation or protection of the post-frame building.

As indicted above, the one or more skirt panels 10 of the skirt panel system of the present disclosure are configured for attachment to at least one post 70 of the post-frame building. That is, the one or more skirt panels 10 may have one or more features that facilitate their attachment to the at least one post 70. For example, such features may include apertures for receiving fasteners (e.g. bolts, screws, and the like) therethrough for attaching the one or more precast skirt panels 10 to the at least one post 70.

However, in a further embodiment, the skirt panel systems of the present disclosure may comprise an attachment apparatus 30 for attaching the one or more precast skirt panels 10 to the at least one post 70. As used herein "attachment apparatus" refers to any means that is capable of maintaining the positioning of the one or more precast skirt panels 10 relative to the building. The one or more precast skirt panels 10 may have features for facilitating connection to the attachment apparatus 30. For example, the one or more precast skirt panels 10 may have recesses for receiving a fastener (e.g. a screw or a bolt) therein, the recesses aligning with apertures located in the attachment apparatus 30 for receiving the fastener therethrough. Of course, many configurations are possible and are contemplated. Additional configurations are also described below. Generally, the attachment apparatus 30 may be fixedly connected to the at least one post 70 of the post-frame building. This may be accomplished using any suitable means known in the art. For example and without limitation, the attachment apparatus 30 may be fixedly connected to the at least one post 70 of the post-frame building by way of fasteners such as bolts, screws, or the like.

Figure 2:
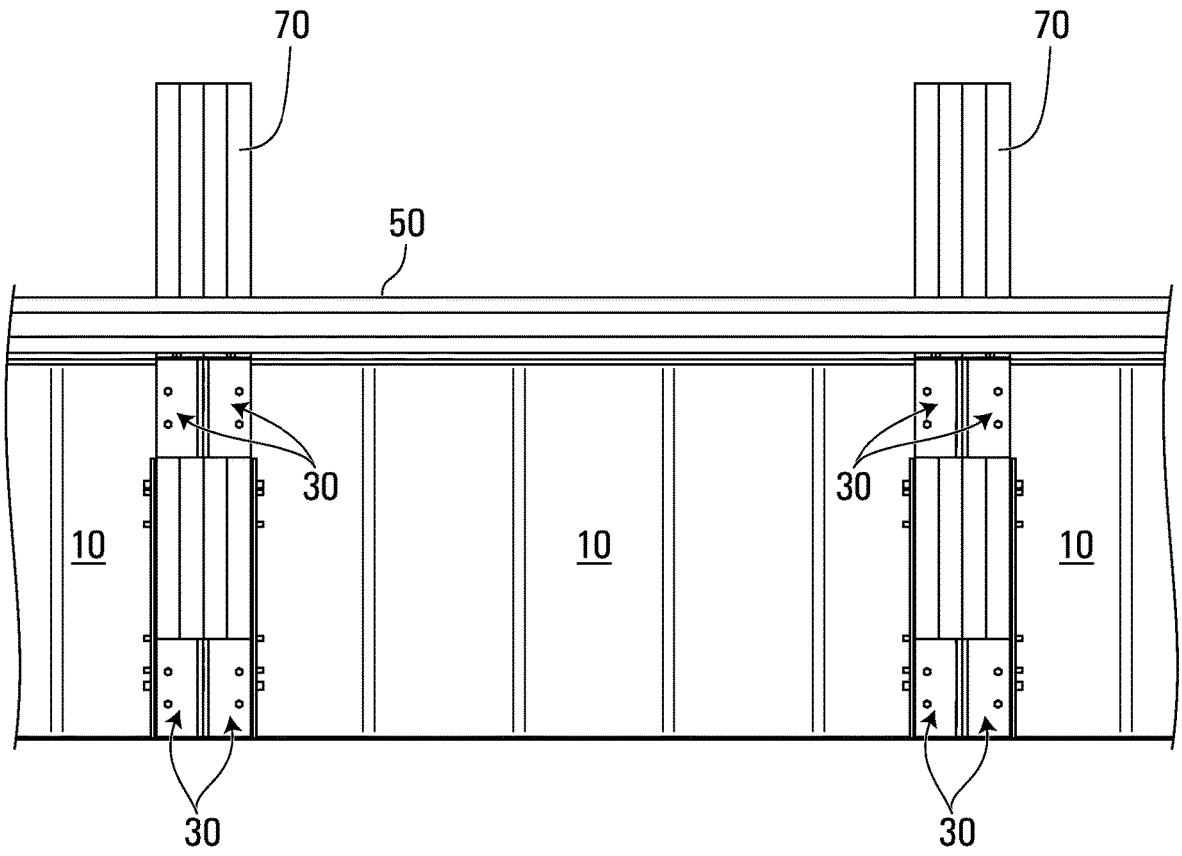
FIG. 2 is a front view of a skirt panel system according to one embodiment of the present disclosure.

The attachment apparatus 30 may have a variety of configurations. For example, in some embodiments, the attachment apparatus 30 may be configured to be fixedly connected to the at least one post 70 of the post-frame building and to a single panel of the one or more precast skirt panels 10. In such embodiments, it is possible that the one or more skirt panels may be mounted on an interior and/or exterior side of the post or positioned between the posts. In other embodiments, the attachment apparatus 30 may be configured to be fixedly connected to the at least one post 70 of the post-frame building and to two of the one or more precast skirt panels 10. In such embodiments, the attachment apparatus 30 may connect to a first panel and a second panel of the one or more precast skirt panels 10 in such a manner so as to form a discontinuous skirt wall 20 (i.e. there is a gap between the one or more precast skirt panels 10), as illustrated in FIG. 2.

However, in another embodiment, the one or more precast skirt panels 10 may be configured for abutting each other end-to-end to form the skirt wall 20. That is, while the one or more precast skirt panels 10 may form a discontinuous skirt wall 20, as described above, they, alternatively, may be arranged to form a generally continuous skirt wall 20 (i.e. there is no gap or space between the one or more precast skirt panels 10). Further, it is noted that, in some embodiments, the one or more precast skirt panels 10 may comprise a groove (not shown) on one of the opposing ends thereof and a tongue (not shown) on the other of the opposing ends thereof, so as to form a tongue-and-groove connection between adjacent precast skirt panels 10 when installed on the post-frame building. Such features may be particularly beneficial for forming a sealed skirt wall 20 when the attachment apparatus 30 is configured to bridge the one or more precast skirt panels 10.

Figure 3:
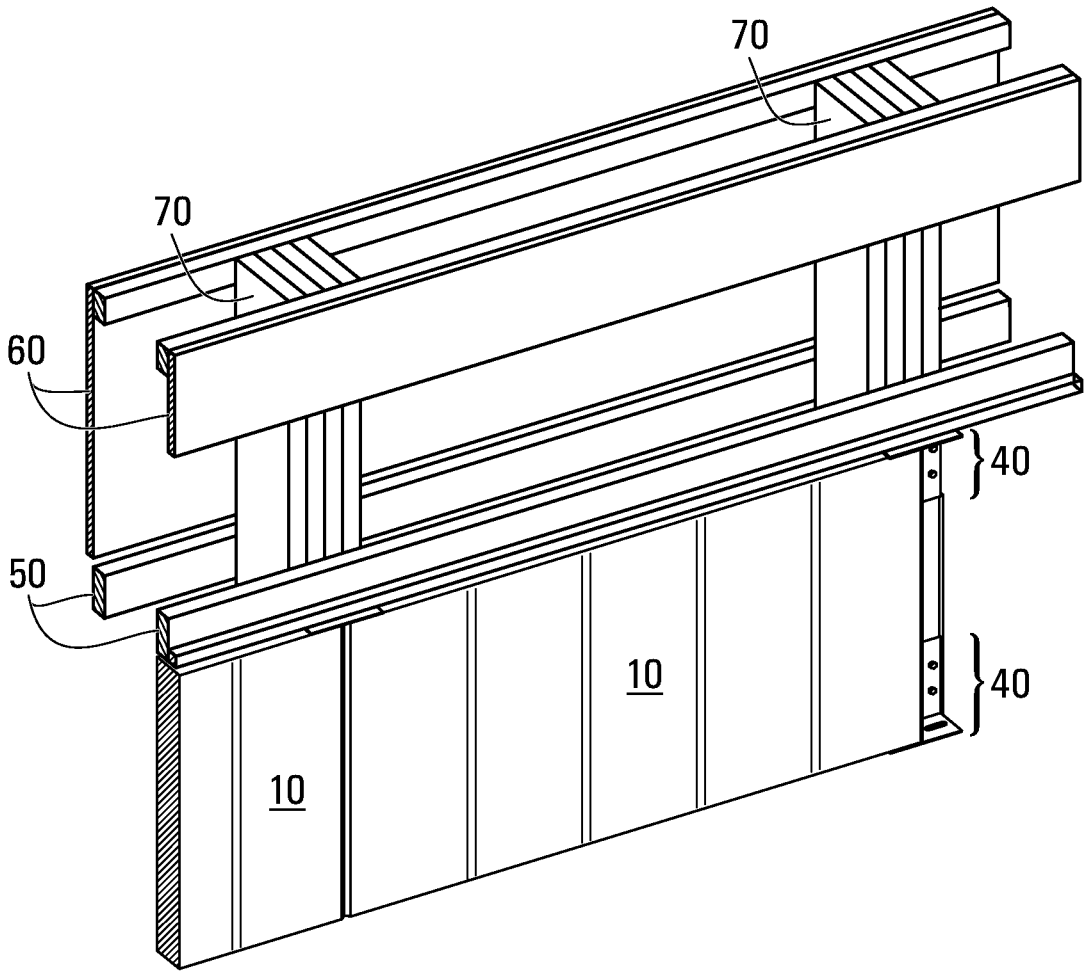
FIG. 3 is a perspective view of a skirt panel system according to one embodiment of the present disclosure.

In some embodiments, the attachment apparatus 30 may be configured to bridge the first panel and the second panel of the one or more precast skirt panels 10. By "bridge" it is meant that the attachment apparatus 30 connects to a first panel and a second panel of the one or more precast skirt panels 10, as illustrated in FIGS. 1, 2 and 3.

Further, in some embodiments, the attachment apparatus 30 may be configured to be fixedly connected to the at least one post 70 of the post-frame building and slidably connected to the one or more precast skirt panels 10. In such embodiments, the one or more precast skirt panels 10 may be slidably disposed along a wall of the post-frame building such that they are slidable into and out of position at the wall of the building during installation or during removal. Such embodiments may beneficially facilitate the ease of installation and/or removal of the one or more precast skirt panels 10.

Figure 4:
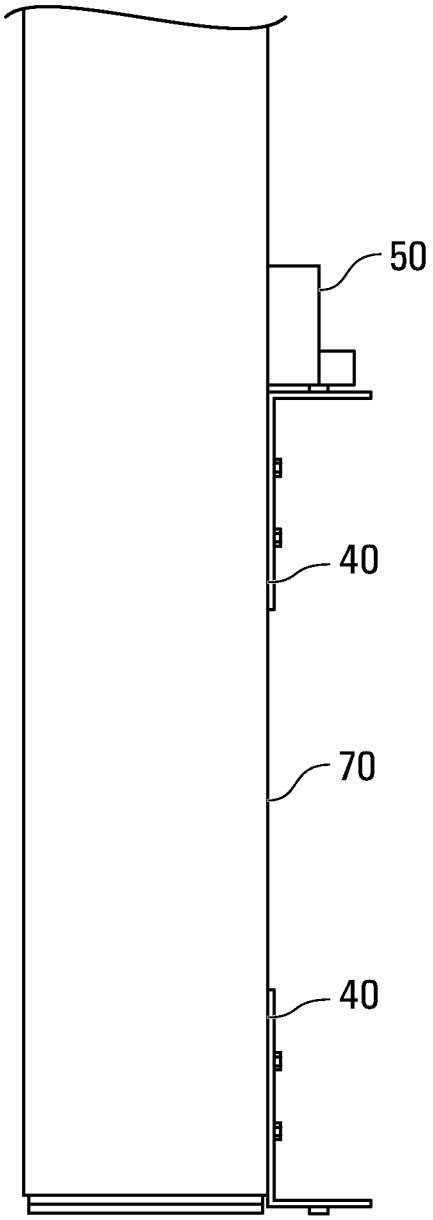
FIG. 4 is a side view of an attachment apparatus according to one embodiment of the present disclosure.
Figure 5:
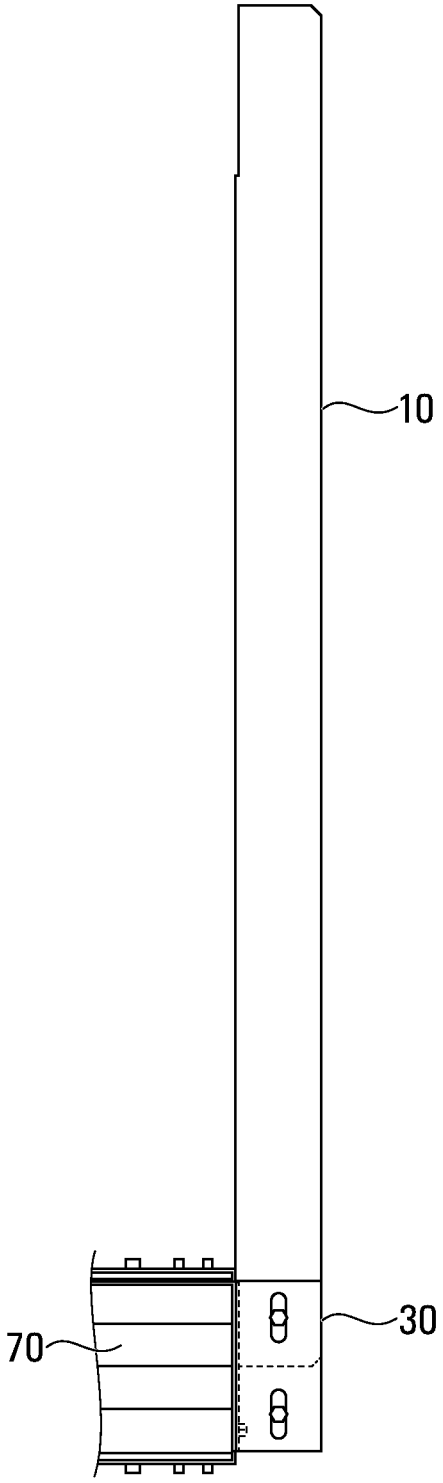
FIG. 5 is a schematic top view of a skirt panel system according to one embodiment of the present disclosure.

The attachment apparatus 30 may be configured to connect to the one or more precast skirt panels 10 using a variety of methods in order to afford the above-described configurations. For example, the attachment apparatus 30 may comprise a bracket 40, as illustrated in FIGS. 3 and 4. The bracket may receive a single or two precast skirt panels 10 and position them along a side of the post frame building. Further, the bracket 40 may be an L-shaped bracket, such as in the illustrated embodiment. The L-shaped bracket may facilitate the connection of the attachment apparatus 30 to the at least one post 70 of the post-frame building and to the one or more precast skirt panels 10. It is noted that the bracket 40 may be formed of any suitable material. For example and without limitation, the bracket 40 may be formed of a metal such as steel or aluminum.

The bracket 40 may be connected to the one or more precast skirt panels 10 using, for example, fasteners such as bolts, screws, and the like. In order to fixedly connect the bracket 40 to the one or more precast skirt panels 10, the bracket 40 may comprise one or more apertures for receiving a fastener therethrough. In embodiments where the attachment apparatus 30 is slidably connected to the one or more precast skirt panels 10, the bracket 40 may comprise a recess or protrusion that is complementary to a recess or protrusion of the one or more precast skirt panels 10 for forming a tough-and-groove connection with the one or more precast skirt panels 10. Such connections may maintain the position of the one or more precast skirt panels 10 while allowing the one or more precast skirt panels 10 to slide relative to the attachment apparatus 30. Of course, other types of connections are possible and are contemplated.

In some embodiments, the bracket 40 of the attachment apparatus 30 may attach the top of one or more precast skirt panels 10 to the at least one post 70 of the post-frame building. In other embodiments, the bracket 40 may attach the bottom of the one or more precast skirt panels 10 to the at least one post 70 of the post-frame building. However, in some other embodiments, the bracket 40 may be sized and configured to attach both the bottom and the top of one or more precast skirt panels 10 to the at least one post 70 of the post-frame building. In such embodiments, the bracket 40 may be a U-shaped bracket that is sized to span the height of the one or more precast skirt panels 10. Further, the bracket may be configured to slidably connect to the bottom of the one or more precast skirt panels 10 (e.g. by way of the tongue-and-grove connection previously described herein) and to fixedly connect to the top of the one or more precast skirt panels 10 (e.g. by way of the fasteners previously described herein).

Further, in some embodiments, the attachment apparatus 30 may comprise two or more brackets 40. In such embodiments, the attachment apparatus 30 may comprise a bracket for attaching the one or more precast skirt panels 10 to the at least one post 70 of the post-frame building at the top and a bracket for attaching the one or more precast skirt panels 10 to the at least one post 70 of the post-frame building at the bottom. Alternatively, each bracket may be configured to attach the one or more precast skirt panels 10 to the at least one post 70 of the post-frame building at both the top and the bottom. Further, the attachment member 30 may comprise a bottom bracket configured such that the one or more precast skirt panels 10 are slidably disposable (e.g. forms the tongue-and-grove connection previously described herein) and a top bracket configured such that the one or more precast skirt panels 10 are fixedly attachable in a fixed position (e.g. is fastened to the one or more precast skirt panels 10 by way of fasteners).

In another embodiment, the one or more precast skirt panels, when installed on the post-frame building, are individually replaceable. That is, the one or more precast skirt panels 10 may be individually disconnected from the at least one post 70 and/or the attachment apparatus 30 without affecting adjacent skirt panels. This may be afforded by the configurations of the one or more precast skirt panels 10 and/or attachment system 30 previously described herein. This may particularly useful, for example, in situations where a single precast skirt panel of a skirt wall of the present disclosure is damaged, as the damaged skirt panel may be replaced without the need to dismantle the entire skirt wall. Such configurations may therefore lower both the time and cost of repairs.

In a further embodiment, the one or more precast skirt panels 10 may comprise interior skirt panels (not shown). The interior skirt panels may be configured to be installed on an interior side (i.e. a side facing the inside of the building) of the at least one post 70 of the post-frame building. The interior skirt panels may be configured and attached to the posts in the same manner as described above in relation to the one or more precast skirt panels 10. Further, in some embodiments, the one or more precast skirt panels 10 may comprise exterior skirt panels, such as those shown in FIGS. 1 to 5, that are configured to be installed on an exterior side of the at least one post 70 of the post-frame building. Like the interior skirt panels, the exterior skirt panels may be configured and attached to the posts in the same manner as described above in relation to the one or more precast skirt panels 10. The use of interior and/or exterior skirt panels may be beneficial if the skirt panel system is to be installed on a building that has a pre-existing (i.e. previously installed or constructed) wall. For example, the exterior and interior skirt panels may be installed on both sides of the at least one post 70 and a wall of a post-frame building, thereby providing the above-described advantages without the need to remove a portion of the wall.

In a further embodiment, the skirt panel system of the present disclosure may comprise a multi-functional top beam 50. The multi-functional top beam 50 may extend orthogonally relative to the at least one post 70 of the post-frame building and across the top of the one or more skirt panels 10. The multi-functional top beam 50 may be comprised of one or more suitable materials such as wood, metal, and the like. The multi-functional top beam 50 may be configured to be fixedly connected to the at least one post 70 of the post-frame building and to the attachment apparatus 30, thereby providing increased structural support to the building and to the one or more skirt panels 10. As well, the multi-functional top beam 50 may also be configured to provide a mounting surface for a building siding 60 (as shown in FIG. 3). The siding 60 may be, for example, a metal siding. The multi-functional top beam 50 may extend across the top of one or more precast skirt panels 10. The positioning of the multi-functional top beam 50 may allow siding 60 to abut the one or more precast skirt panels 10 while being secured to the building by way of, for example, an exterior-facing (i.e. facing away from the interior of the building) surface of the multi-functional top beam 50. Such a configuration may make it more difficult for precipitation (e.g. rain, snow, etc.) as well as unwanted wildlife to enter the building between the one or more panels 10 and the siding 60. As well, inclusion of the multi-functional top beam 50 may be beneficial in embodiments where the one or more precast skirt panels 10 are precast of a material that may be relatively difficult to attach building siding to (e.g. brick or stone).

Further, as will be appreciated, when the one or more precast skirt panels 10 comprise interior panels, as previously described herein, the multi-functional top beam 50 may be on the interior side of the at least one post 70. When the one or more precast skirt panels 10 comprise exterior panels, the multi-functional top beam 50 may be on the exterior side of the at least one post 70. Further, when the one or more precast skirt panels 10 comprise interior and exterior panels, the skirt panel system may comprise a multi-functional beam 50 on both an interior and an exterior side of the at least one post 70.

As previously described herein, the skirt panel system of the present disclosure, when installed on a post-frame building, may be configured to replace a grade beam foundation that requires excavation below a frost line. As used herein, "grade beam" or "grade beam foundation" is intended to refer to a reinforcing, horizontally positioned beam that transmits the load from load-bearing features of a building to the ground. The grade beam generally extends from above to below grade.

The replacement of the grade beam foundation may be accomplished in a variety of ways. For example, in one embodiment, the one or more precast skirt panels 10 and the attachment apparatus 30 may be configured such that the one or more precast skirt panels 10 are installed on the post-frame building with the bottom of the one or more precast skirt panels 10 adjacent to an exterior surface of a concrete slab 80 of the post-frame building. It is noted that, as used herein, "adjacent to an exterior surface of a concrete slab" is intended to mean that the bottom of the one or more precast skirt panels 10 may be positioned such that the one or more precast skirt panels 10 are located immediately in front of (e.g. abutting) the exterior surface of the concrete slab 80, the exterior surface being the surface that faces the same direction as the outer surface of the one or more precast skirt panels 10. Thus, in in one embodiment, the bottom of the one or more precast skirt panels 10 may be positioned on or in the ground directly in front of the concrete slab 80. In a further embodiment, the bottom of the one or more precast skirt panels 10 may be positioned such that they are about 1 inch to about 10 inches below grade. In a yet further embodiment, the bottom of the one or more precast skirt panels 10 may be positioned such that they are about 3 inches to about 4 inches below grade. Such configurations may afford the advantages previously descried herein.

The skirt panel system of the present disclosure may also be installed on the post-frame building such that the one or more precast skirt panels 10 are positioned above a perimeter foundation, a concrete slab 80, or a grade beam of the post-frame building. In such embodiments, the bottom of the one or more precast skirt panels 10 may abut a top surface of the perimeter foundation, the concrete slab 80, or the grade beam. Such configurations may advantageously still afford many of the benefits previously described herein (e.g. increased protection for the posts of the building and restricted access of unwanted wildlife such as rodents to the building) for buildings that have already been constructed using a perimeter foundation or grade beam.

Thus, the skirt panel system of the present disclosure may afford a number of advantages. For example, the skirt panel system may replace typical grade beam applications that require excavation below the frost line, site cribbing, site pour and framing. As well, the replacement of the grade beam may expand the applicability of post-frame technology to types of buildings that not conventionally constructed as post-frame buildings, as previously discussed herein. Further, the skirt panel system is flexible in that it may be installed on an interior and/or exterior side of a post-frame building and is thus capable of providing protection to both the interior and exterior of the building. These and other advantages have been described in greater detail above. As well, additional advantages will be described below.

Methods for and Uses in Constructing a Post-Frame Building

There is further provided a method of constructing a post-frame building, using the skirt panel system of the present disclosure. The constructed post-frame building may afford the advantages previously discussed herein. Further, it is noted that like terms are intended to have their same meaning as previously defined herein in relation to the skirt panel system.

In an embodiment, the present disclosure relates to a method for constructing a post-frame building, the method comprising: setting in place, upright, one or more posts of a post-frame building; and attaching to the one or more posts the skirt panel system of the present disclosure.

It is noted that, as used herein "setting in place, upright" is intended to refer to erecting one or more posts 70 of the post-frame building such that they are maintained generally orthogonal to the ground. The one or more posts 70 may be maintained in an upright position by anchoring one end thereof to, for example, a concrete slab 80. Alternatively, the one or more posts 70 may be maintained in an upright position by burying an end thereof in the ground. The end of the one or more posts 70 that is buried in the ground may be encased in concrete for added stability. Further, in some embodiments, the setting in place, upright of the one or more posts 70 of the post frame building comprises positioning one end of the one or more posts 70 below a frost line. In such embodiments, the positioning of the one end of the one or more posts 70 below the frost line comprises setting the one end at a depth of up to about 8 feet below grade. In a particular embodiment, the positioning of the one end of the one or more posts 70 below the frost line comprises setting the one end at a depth of between about 3 to about 5 feet below grade.

In a further embodiment, the attaching of the skirt panel system to the one or more posts 70 is by mounting L-shaped brackets to the one or more posts 70 and attaching the one or more precast skirt panels 10 to the L-shaped brackets. As will be appreciated by those of ordinary skill in the art, the order of the mounting of the L-shaped brackets and the attaching of the one or more precast skirt panels 10 may be completed in any order. Further, the mounting of the L-shaped brackets on the one or more posts 70 may be completed using any suitable means. For example, and as previously described herein, the L-shaped brackets may be mounted on the one or more posts 70 by way of fasteners such as bolts, screws, or the like. The attaching of the one or more precast skirt panels 10 to the L-shaped brackets may be completed in the same manner as previously described herein in relation to the attachment apparatus 30.

Further, in one embodiment, the methods of constructing the post-frame building may further comprise pouring a concrete slab 80 for the post-frame building. Those of ordinary skill in the art are familiar with the pouring of concrete slabs for such purposes. In some embodiments, the attaching of the skirt panel system to the one or more posts 70 therefore may comprise positioning the bottom of the one or more precast skirt panels 10 adjacent to an exterior surface of the concrete slab 80. In such embodiments, the bottom of the one or more precast skirt panels 10 may be aligned (i.e. at about the same level) with the bottom of the concrete slab 80. In another embodiment, the bottom of the bottom of the one or more precast skirt panels 10 may be positioned at a depth of about 1 inch to about 10 inches below grade. In a further embodiment, the bottom of the one or more precast skirt panels 10 may be at a depth that is between about 2 inches to about 5 inches below grade. In a yet further particular embodiment, the bottom of the one or more precast skirt panels 10 may be at a depth that is between about 3 inches to about 4 inches below grade.

As will be appreciated by those of ordinary skill in the art, the positioning of the one or more precast skirt panels 10 may be accomplished, for example, by selectively attaching the one or more skirt panels 10 to the one or more posts 70 (e.g. by way of the attachment apparatus 30) at a height that will place the bottom of the one or more precast skirt panels 10 at the desired level (e.g. aligned with or below the bottom the concrete slab).

Further, as described above, the one or more precast skirt panels 10 may comprise interior and/or exterior skirt panels. Thus, in one embodiment, the methods of the present disclosure may comprise attaching the one or more precast skirt panels 10 of the skirt panel system to an interior side of the one or more posts 70 and/or to an exterior side of the one or more posts 70.

Additionally, in an embodiment, the methods of the present disclosure may comprise affixing building siding 60 to the post-frame building above the one or more precast skirt panels 10. This may be accomplished using techniques known in the art. For example, the siding may be fastened to the posts of the post-frame building. As well, the type of building siding is not limited to a particular type and may vary depending on the purpose of the post-frame building (e.g. agriculture, horticulture, recreational, etc.) as well as the location of the siding (e.g. exterior or interior).

Furthermore, in one embodiment, the present disclosure relates to a use of the skirt panel system in the construction of a post-frame building. The use of the skirt panel system in the construction of the post-frame building may comprise use in performing, for example, any of the method steps previously described herein.

Thus, the present disclosure provides methods of and uses in constructing a post-frame building that may afford the advantages previously discussed herein. As well, the methods and uses themselves provide a number of advantages. For example, the methods of constructing a post-frame building disclosed herein may not require steps such as excavating a perimeter trench, pouring a strip footing, cribbing a grade beam, pouring walls, and backfilling the walls. Rather, the methods of the present disclosure may be performed with a minimized ground disturbance, thereby reducing the need for heavy machinery and providing environmental benefits. The uses may afford these same advantages. Thus, the methods and uses of the present disclosure may save a significant amount of costs, labor and time.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A method for constructing a post-frame building, the method comprising:

setting in place, vertically upright, two or more posts of a post-frame building;

pouring a concrete slab on the ground for the post-frame building at grade level, the concrete slab providing a floor to the post-frame building and extending between adjacent posts to align the exterior-facing side surface of the concrete slab with an exterior side of the posts; and attaching to the exterior side of two or more posts by way of an attachment apparatus mounted to each post, a skirt panel system having one or more precast skirt panels, each of the precast skirt panels having an outer surface to be oriented away from the interior of the post-frame building, an inner surface to be oriented towards the interior of the post-frame building, a top, a bottom, and two opposing ends, wherein the attaching of the precast skirt panels to the posts maintains the positioning of the precast skirt panels on the post-frame building by way of the attachment apparatus; abuts the inner surface of the precast skirt panel against the exterior-facing side surface of the concrete slab, aligns the bottom of the precast skirt panel with the bottom of the concrete slab or positions the bottom of the precast skirt panel below the bottom of the concrete slab, and positions the bottom of the precast skirt panel below grade; and and wherein the setting in place of the two or more posts comprises burying one end of each post below the concrete slab at a depth of up to about 8 feet below grade.

2. The method according to claim 1, wherein attaching the skirt panel system to the two or more posts is by mounting L-shaped brackets to the posts and attaching the precast skirt panels to the L-shaped brackets.

3. The method according to claim 1, wherein attaching the precast skirt panels to the posts aligns the bottom of the precast skirt panel with the bottom of the concrete slab.

4. The method according to claim 1, wherein attaching the precast skirt panels to the posts positions the bottom of the precast skirt panel below the bottom of the concrete slab.

5. The method according to claim 1, wherein attaching the precast skirt panels to the posts positons the bottom of the precast skirt panel at a depth that is between about 2 inches to about 5 inches below grade.

6. The method according to claim 1, wherein attaching the precast skirt panels to the posts positons the bottom of the precast skirt panel at a depth that is about 3 inches or about 4 inches below grade.

7. The method according to claim 1, wherein setting in place, vertically upright, the two or more posts of the post-frame building comprises positioning one end of the posts below the frost line.

8. The method according to claim 1, further comprising a step of affixing a building siding to the post-frame building above the one or more precast skirt panels.

9. The method according to claim 1, wherein attaching the skirt panel system to the two or more posts comprises sliding the precast skirt panels atop bottom brackets mounted to the posts below grade, and fixedly positioning the precast skirt panel by top brackets mounted to the posts at a position aligned with the top of the precast skirt panels.

10. The method according to claim 1, wherein attaching the skirt panel system to the two or more posts comprises abutting each of the precast skirt panels end-to-end to form a skirt wall on the post frame building.

11. The method according to claim 1, wherein the one or more precast skirt panels are precast of a rigid, durable material.

12. The method according to claim 11, wherein the one or more precast skirt panels are precast of concrete.

13. The method according to claim 1, wherein the one or more precast skirt panels each have a thickness of about 2 inches to about 4 inches, as measured from the outer surface to the inner surface.

14. The method according to claim 12, wherein the one or more precast skirt panels comprise an internal reinforcement comprised of metal.

15. The method according to claim 1, wherein the one or more precast skirt panels are between about 2 feet to about 4 feet in height from the bottom to the top.

16. The method according to claim 1, wherein the setting in place of the two or more posts comprises burying the one end of each post below the concrete slab at a depth of between about 3 feet to about 5 feet below grade.

* * * * *